US007302711B1

(12) United States Patent
Tanenbaum

(10) Patent No.: US 7,302,711 B1
(45) Date of Patent: Dec. 4, 2007

(54) ELASTIC FLAP WITH SLEEVE AND GLOVE FOR LIQUID IMPERVIOUS SEAL

(76) Inventor: Michael Tanenbaum, 1222 Weatherstone Dr., Atlanta, GA (US) 30324

( * ) Notice: Subject to any disclaimer, the term of this patent is extended or adjusted under 35 U.S.C. 154(b) by 0 days.

(21) Appl. No.: 11/093,404

(22) Filed: Mar. 29, 2005

Related U.S. Application Data

(63) Continuation-in-part of application No. 10/131,953, filed on Apr. 24, 2002, now Pat. No. 6,941,579.

(60) Provisional application No. 60/286,270, filed on Apr. 25, 2001, now abandoned.

(51) Int. Cl.
*A41D 19/00* (2006.01)

(52) U.S. Cl. ..... 2/162; 2/59; 2/161.7

(58) Field of Classification Search ..... 2/59, 2/125, 114, 51
See application file for complete search history.

(56) References Cited

U.S. PATENT DOCUMENTS

| | | | | | |
|---|---|---|---|---|---|
| 2,813,272 | A | * | 11/1957 | Hagan | 285/260 |
| 3,009,164 | A | * | 11/1961 | Frey | 2/270 |
| 3,657,741 | A | | 4/1972 | Blanco | |
| 3,889,297 | A | * | 6/1975 | Jarboe et al. | 2/16 |
| 4,389,734 | A | * | 6/1983 | Franz et al. | 2/59 |
| 4,399,567 | A | | 8/1983 | Weon Joong | |
| 5,033,115 | A | | 7/1991 | Bowling et al. | |
| 5,073,988 | A | | 12/1991 | Lewis, Jr. et al. | |
| 5,555,561 | A | * | 9/1996 | Plachta et al. | 2/457 |
| 5,572,743 | A | | 11/1996 | Yavitz | |
| 5,628,067 | A | | 5/1997 | Meyer et al. | |
| 5,682,616 | A | | 11/1997 | Pisano | |
| 5,924,130 | A | * | 7/1999 | Fragomeli | 2/16 |
| 5,978,960 | A | | 11/1999 | Wrightman | |
| 6,128,785 | A | | 10/2000 | Sommeregger | |
| 6,523,181 | B2 | | 2/2003 | Medves | |
| 6,530,090 | B1 | * | 3/2003 | Ambrose et al. | 2/59 |
| 6,941,579 | B2 | * | 9/2005 | Tanenbaum | 2/123 |
| 2007/0000006 | A1 | * | 1/2007 | Jordan et al. | 2/51 |
| 2007/0000014 | A1 | * | 1/2007 | Rotella et al. | 2/114 |

* cited by examiner

*Primary Examiner*—Katherine Moran
(74) *Attorney, Agent, or Firm*—Daniel P. Dooley; Fellers, Snider, et al.

(57) ABSTRACT

A sleeve-glove attachment assembly for hazardous environments such as surgery, as well as applications where a fluid impervious seal is desirable, such as water or snow activities, is provided to form a fluid impervious seal between a garment sleeve and an elastic glove. The sleeve glove attachment assembly comprising an elastic flap, cylindrical in shape, having a distal end and proximal end is attached near the center of the flap to the sleeve at mid-forearm. At least one of the proximal and distal ends comprising a raised geometric bead and frictional ridges on the outer surface eliminates bunching and channel formation between the glove cuff and sleeve. The glove cuff is placed over the geometric bead and frictional ridges of the distal end of the flap. A method of making the device, method of donning the assembly, and method of removal of the assembly are also provided.

20 Claims, 11 Drawing Sheets

ELASTIC FLAP WITH SLEEVE AND GLOVE FOR LIQUID IMPERVIOUS SEAL

RELATED APPLICATIONS

This application is a continuation-in-part of U.S. Non-Provisional application Ser. No. 10/131,953 now U.S. Pat. No. 6,941,579 filed Apr. 24, 2002, which claims priority to U.S. Provisional application No. 60/286,270 originally filed on Apr. 25, 2001 now abandoned.

BACKGROUND OF THE INVENTION

In accordance with the invention a sleeve-glove attachment assembly is provided for protective garments used in hazardous environments such as surgical hospital settings and testing laboratories as well as garments desiring a waterproof seal at the sleeve-glove interface such as underwater diving suits, motorcycle gear, and snow skiing apparel. Also, the invention may be used at orifices of garments other than the wrist including the neck and ankles. However an immediate solution is needed in the surgical operating room setting, so reference to this application will be explained in detail.

This invention relates to the fluid barrier properties of surgical operating room personal protective equipment (PPE). The barrier properties are vital to the healthcare worker because of blood-borne infectious diseases and deadly viruses such as Hepatitis C and HIV. Conditions like Hepatitis C do not currently have vaccines and post-operation prophylaxis, often resulting in fatal consequences. The safety of the patient undergoing surgery may also become threatened if the liquid barrier garments of the caregiver are not sealed, especially at the fingers, hands, and wrists. Presently, surgical gowns and surgical gloves exist that provide safe liquid barriers as independent devices. However, the surgical glove-gown sleeve interface is the weakest link of all PPE because the glove and gown do not form a complete uniform seal, and potentially hazardous fluids such as blood and other bodily fluids are allowed to travel between the gown and the glove, eventually reaching the skin of the user. Although the materials of currently used surgical gowns and surgical gloves are fluid resistant and even fluid impermeable, the interface of the two is not. During a surgical procedure, blood may be sprayed or squirted from the patient onto the gown chest and upper arms. Due to the resistance to fluid of the gown material, the fluids tend to bead up on the gown and run or travel down the material instead of soaking through. The problem however, is that the fluids have a tendency to run or travel to the interface of the gown and glove, and may continue to travel through the interface, through channels and air pockets separating the gown and the glove, and thereby contacting the skin of the user.

In developing a solution to the glove-gown sleeve interface problem, one must understand the procedures of the operating room, constraints of the surgeons, and how PPE is donned.

PPE must not interfere with procedures performed by surgeons and their assistants. PPE should provide: maximum view of the surgeon's hands, maximum ventilation, non-limited sizing, fast time to don and remove, acceptable hoop stress/pressure at hands and wrists, and prevent penetration of infectious or undesirable fluids such as blood, urine, and other bodily fluids.

The surgeon and assistant nurses typically wear a reusable woven fabric or disposable nonwoven fabric gown. The sleeve of the surgical gown is baggy to allow free movement of the user's arms. The end of the sleeve, the stockinet, is typically manufactured with an absorbent material that performs two functions. First, the stockinet provides a comfortable layer that contacts the skin. Secondly, the stockinet is worn around the base of the hand tightly under the glove to provide a means of stabilizing the gown and glove interface during surgery. The surgical gloves are made of elastic synthetic or natural rubber latex. Other PPE includes face shields, masks, goggles, and shoe covers.

After scrubbing, the surgeon dons the surgical gown. The hands remain inside the gown sleeve while an assistant opens the glove cuff opening. The surgeon then pushes his or her hand into the glove, then immediately pushing the hand through the stockinet and into the fingers of the glove. The assistant nurse would then pull the cuff of the surgical glove proximally toward the forearm over the baggy gown sleeve material.

The potential for fluids to contact the surgeon not only exists during the surgical procedure, but also exists upon removal of the apparel. Upon removal of the gloves, the channels and any space between the glove and gown is increased, and any bodily fluids present on the gloves or gown sleeve surfaces will travel through the interface faster, eventually contacting the skin.

Efforts have been made, attempting to solve the above problems. It has been known to double glove; however double-gloving increases the stress on the wrists and still does not seal the interface. It has also been known to wear longer gloves, which extend to the elbow or further. Longer gloves however, do not seal the interface; they simply move the interface to another location, and in doing so, decrease the breathability, and maneuverability of the user's arms. It has also been known to wrap tape around the interface, however, tape may be bulky, uncomfortable, constricting, messy, and adds time to the donning procedure, and is difficult to remove.

The present invention provides an assembly which solves the above mentioned problems, sealing the gown-glove interface. Methods of making such assemblies, and methods of donning such assemblies are also provided.

SUMMARY OF THE INVENTION

The present invention provides a gown sleeve-glove attachment assembly, which forms a liquid or fluid impervious seal between a fabric sleeve (woven or nonwoven), and elastic glove. The attachment assembly may be present on the gown sleeve surface or on the glove surface. The attachment assembly may also be a separate device, such as a flap, attachable to the gown sleeve, glove, or both. In the preferred embodiment, the sleeve-glove attachment assembly, cylindrical in shape, described herein as a flap or tube having a distal end and proximal end is attached near the center of the flap to the sleeve at mid-forearm with the distal end extending over the sleeve cuff and proximal end extending over the sleeve close to the elbow. At least one of the proximal and distal ends comprising a raised geometric bead and frictional ridges on the outer surface eliminates bunching and channel formation between the glove cuff and sleeve. The glove cuff is placed over the geometric bead and frictional ridges of the distal end of the flap. Then the proximal end of the flap is folded over the distal end of the flap and overlying glove to create a continuous seal against fluids and particles. The interface may comprise one geometric bead, a bead and at least one frictional ridge, multiple geometric beads, multiple geometric beads and multiple frictional ridges, creating a surface texture profile or pattern. The ridges and beads may be strategically placed on one or both of the distal and proximal ends of the flap to create a single continuous seal or an interlocking mesh of beads and ridges. A method of making the invention, method of donning, and method of removal of the assembly is also provided.

These and various other features and advantages which characterize the claimed invention will be apparent from reading the following detailed description and a review of the associated drawings.

DESCRIPTION OF FIGURES

The present invention and its advantages may be understood by reference to the detailed description section when read with the accompanying drawings briefly described below.

DETAILED DESCRIPTION

Figure 1:
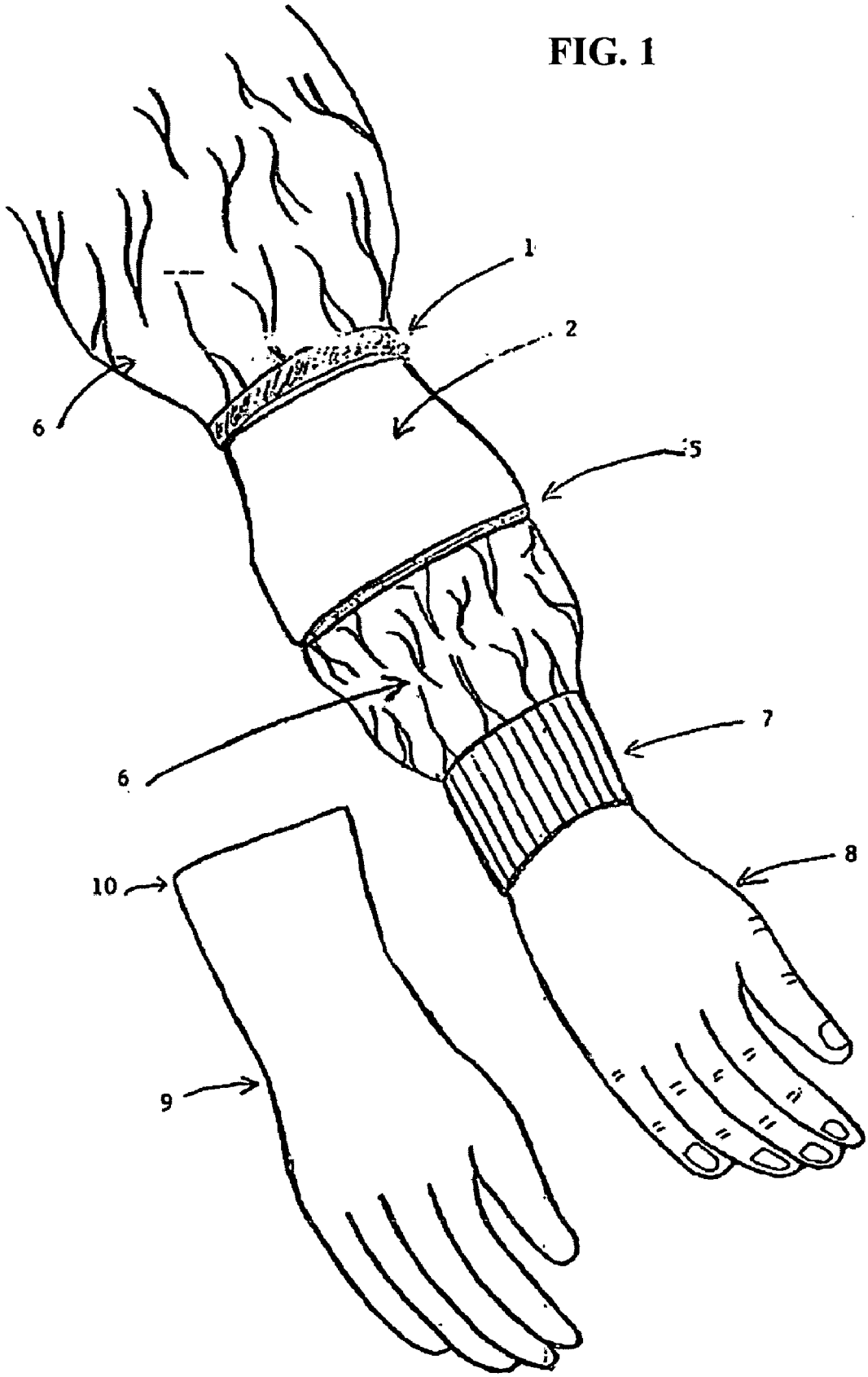
FIG. 1 shows a person wearing a baggy sleeve currently used with one embodiment of the invention, or flap attached to the sleeve. The elastic flap is pulled back over the forearm during donning. A glove is also shown to the side.
Figure 2:
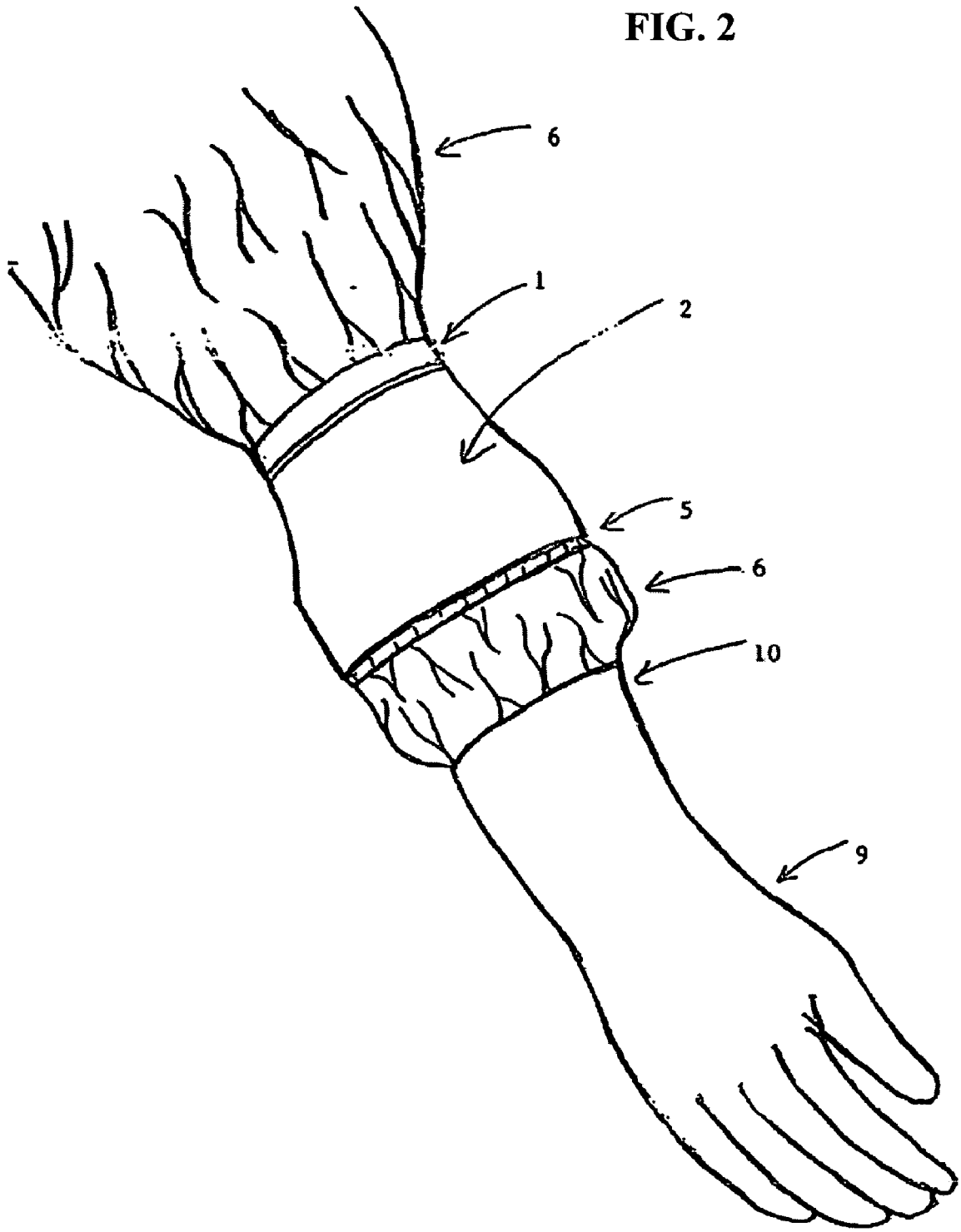
FIG. 2 shows the assembly of FIG. 1 wherein the glove has been donned.
Figure 3:
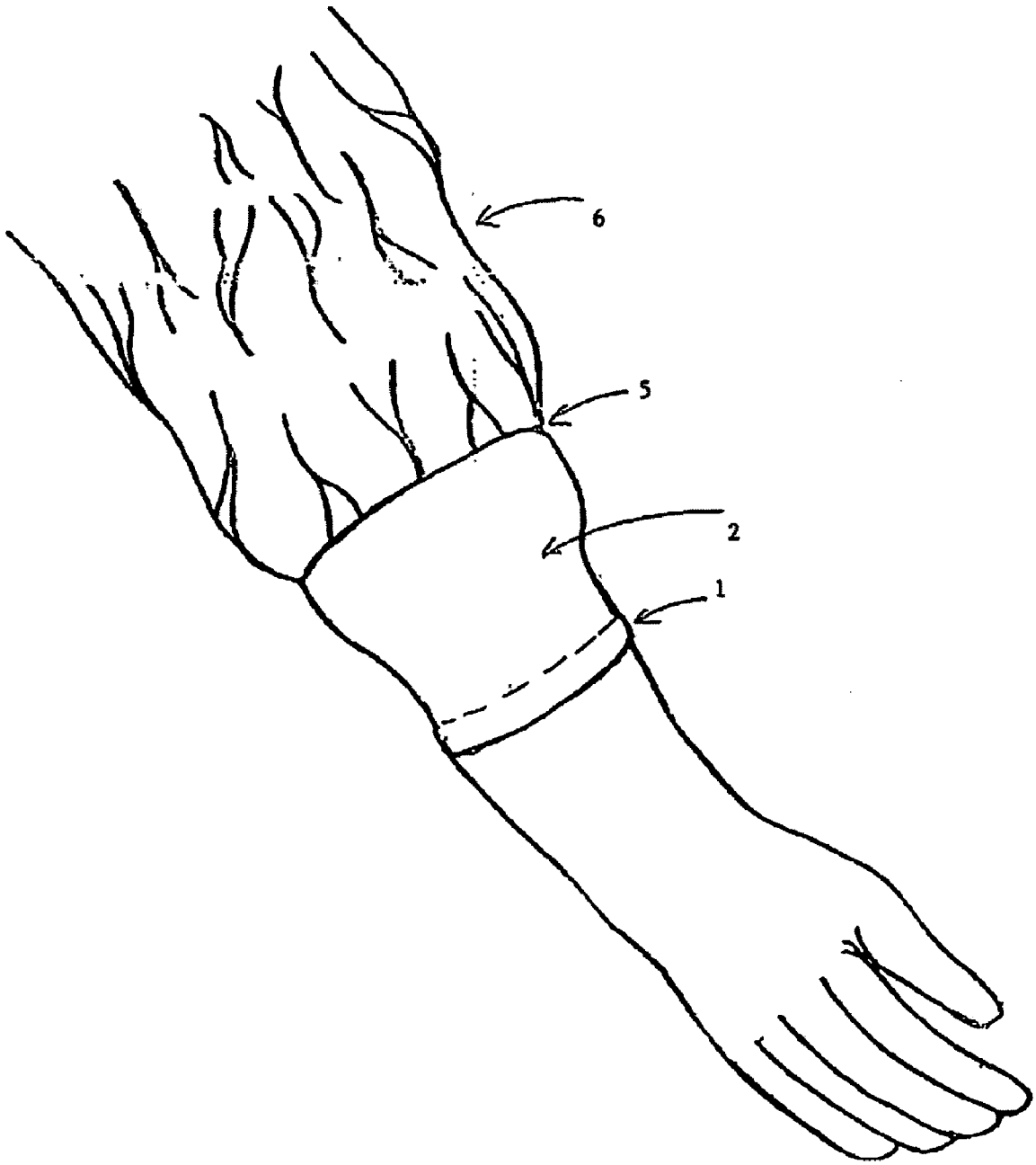
FIG. 3 shows the assembly of FIGS. 1 and 2 wherein the flap has been folded over the glove cuff.

FIGS. 1-6 show a first embodiment of the invention. As shown in FIG. 1, a sleeve (6), (also referred to herein as a cuffed limb covering portion (such as 6)), has an elastic pullover flap (2) attached to the sleeve by at least one circumferential location, shown here to be attached at the proximal end of the flap, however the distal end of the flap is pulled back before donning occurs. Throughout the specification "proximal" will refer to towards the body, towards the elbow or chest and "distal" will refer to away from the body, or towards the fingers or other extremity. The flap may be attached by any known method in the art such as heat bonding, sewing, adhesives, or combination thereof. The preferred method of donning the embodiment shown in FIGS. 2-5 will now be described. The user dons the garment that includes the elastic pullover flap (2) in the pulled back position as shown in FIG. 1. The adhesion point of the pullover flap (5) is shown. Typically the sleeve cuff, commonly known as the stockinet (7) is donned at the base of the hand (8). A glove (9), (also referred to herein as a limb extremity covering member (such as (9)), is shown to the side of the hand (8). A geometric bead (1)), or other surface texture, is positioned near the end of the pullover flap (2) to increase the impervious properties of the seal when the flap is folded over a glove cuff (cuff) (10), (also referred to herein as a limb extremity covering member cuff (such as (10)). Preferably the geometric bead comprises an elastic material FIG. 2 shows a second step of the first embodiment wherein the glove (9) is donned over the stockinet (7). After donning, the cuff (10) end is located proximal to the stockinet (7) visible in FIG. 1. The pullover elastic flap (2) is then folded about the attachment point (5) of the flap (2), as shown in FIG. 3, to completely cover the cuff (10) shown in FIG. 2. The resulting assembly is an innermost sleeve layer (6), cuff (10) surrounding the sleeve layer (6), and outermost elastic flap (2).

Figure 4:
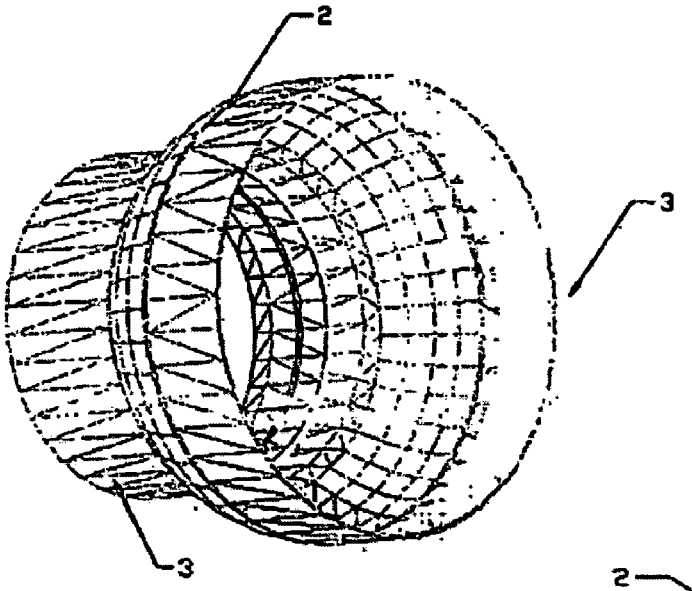
FIG. 4 is a three dimensional CAD drawing of the flap of FIGS. 1-3 viewed from the end attached to the sleeve.
Figure 5:
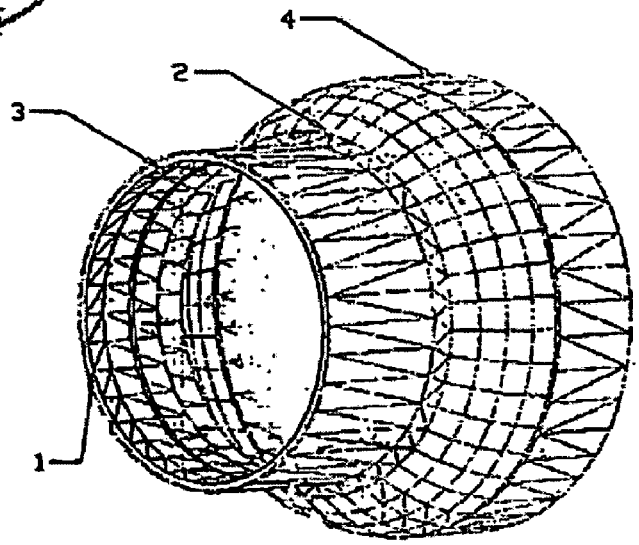
FIG. 5 is a three dimensional CAD drawing of the flap of FIGS. 1-3 viewed from the distal end covering the cuff of the glove.

FIGS. 4 and 5 show three-dimensional views of the elastic pullover flap (2) of FIGS. 1-3. Herein, proximal end refers to the proximal end of the flap before any folding steps. FIG. 4 shows the opening of the proximal end of the elastic flap (4). The circumference of the proximal end of the pullover elastic flap (4) is larger than the distal end of the pullover elastic flap (3) because the proximal end must be adhered to the sleeve when fully expanded. The larger circumference prevents creation of pores that may allow fluids or particles to pass through. Therefore the circumference of the proximal end should be large enough such that unnecessary expansion is not required when attaching the flap to the sleeve. The circumference of the distal end of the pullover elastic flap (3) is smaller to more closely match the circumference of the user's wrist. Preferably the distal end circumference is smaller or substantially equal to the wrist circumference so that the distal end expands to create a continuous seal void of channels or bunching of the interface materials. However, depending on the amount of excess sleeve material that would accumulate under the interface of the invention, it may be desirable to select a circumference larger than the wrist of the user to prevent unnecessary expansion of the flap.

Figure 6:
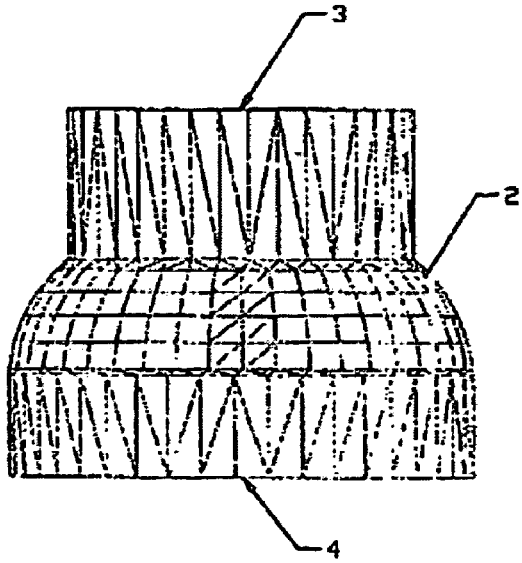
FIG. 6 shows the profile of the flap of FIGS. 1-3.

The profile of the flap (2) is shown in FIG. 6. The central portion of the flap may taper in a curved (shown) or straight manner. FIG. 5 shows the rectangular geometric bead (1) placed on the inside surface of the distal end of the elastic pullover flap (2).

Figure 7:
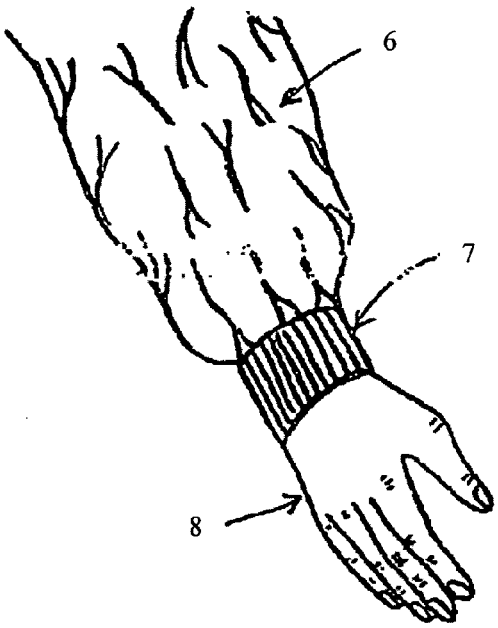
FIG. 7 shows a person wearing a baggy sleeve with an elastic fabric cuff.

FIGS. 7 through 10 show preferred donning steps of a second embodiment of the invention. The preferred method of donning the embodiment shown in FIGS. 7-10 will now be described. FIG. 7 shows a person with an unmodified sleeve (6) pulled over the arm and terminating at the base of the hand (8).

Figure 8:
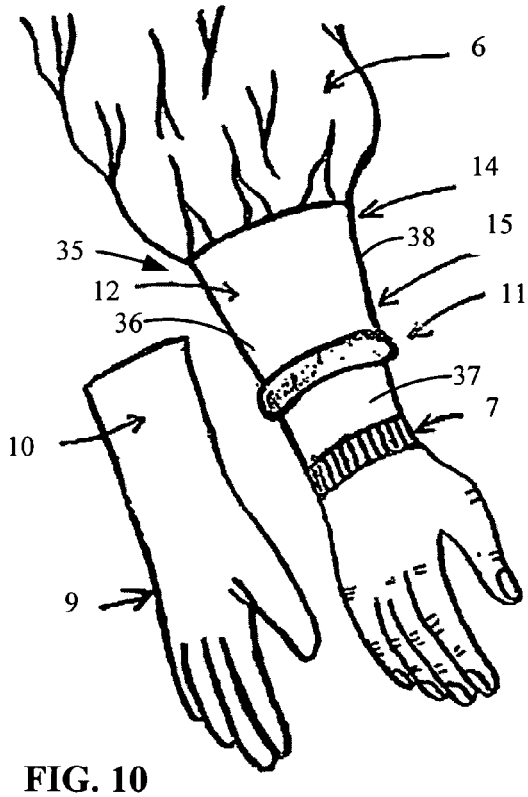
FIG. 8 shows a second embodiment of a flap attached to a baggy sleeve. A glove is shown to the side. The elastic flap is adhered to the sleeve at a point near the center of the flap.
Figure 18:
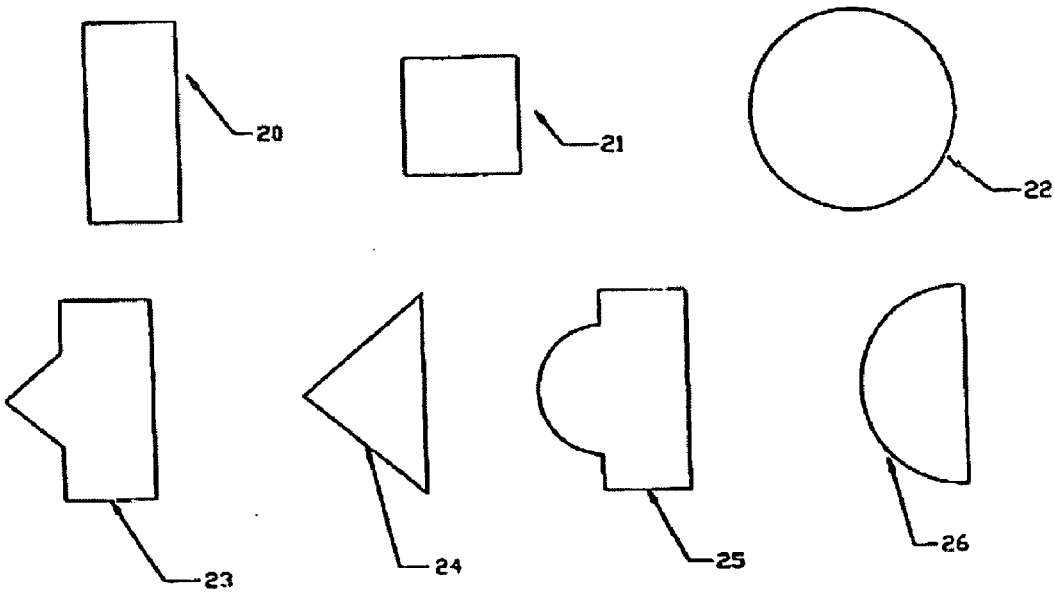
FIG. 18 shows possible profiles for the geometric bead of all embodiments of the invention.

FIG. 8 shows a similar sleeve (6) having an elastic folding flap (12) attached to the sleeve by at least one attachment location. Preferably one attachment point is located near the middle of the longitudinal length of the flap (15). A second attachment point may be located near the stockinet (7) to prevent the distal end of the flap from moving out of position. Any suitable means of attachment as described with the first embodiment may be used. The elastic folding flap includes a geometrical bead (11) on the outer surface near the distal end of the flap, and material (36) and (37) extending from the geometrical bead (11). The geometrical bead (11), the material (36), and the material (37) collectively forms a profile (38) of a retention region (35). The profile shape of the geometrical bead in FIGS. 8 through 11 is a semicircle, although other profiles of the bead may be used as is shown in FIG. 18. A glove (9) is shown in FIG. 8 to represent the extent at which the cuff (10) reaches when donned over the elastic folding flap (12). Notice that the cuff (10) will be donned just beyond the geometric bead on the distal end of the elastic folding flap (12).

Figure 9:
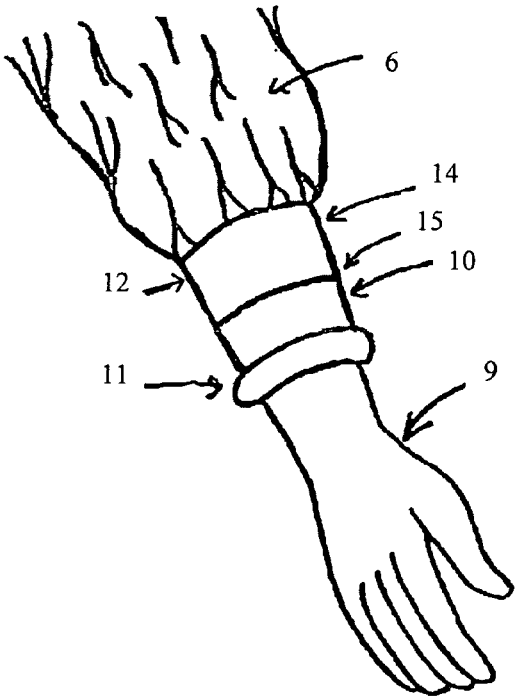
FIG. 9 shows a glove donned over the distal end of the flap of FIG. 8.

FIG. 9 shows the glove (9) donned over the elastic folding flap (12). The geometric bead (11) on the elastic folding flap (12) expands the circumference of the donned cuff (10) so that the cuff (10) smoothly conforms to the shape of the geometric bead. The smooth conformation and contracting force of the cuff (10) creates a tight, continuous and uniform seal. During this step the proximal end (14) of the elastic folding flap (12) remains in the pulled back position. The final step requires the proximal end (14) of the elastic folding flap (12) to be folded over the cuff(10) about the attachment point (15) located near the middle of the flap.

Figure 10:
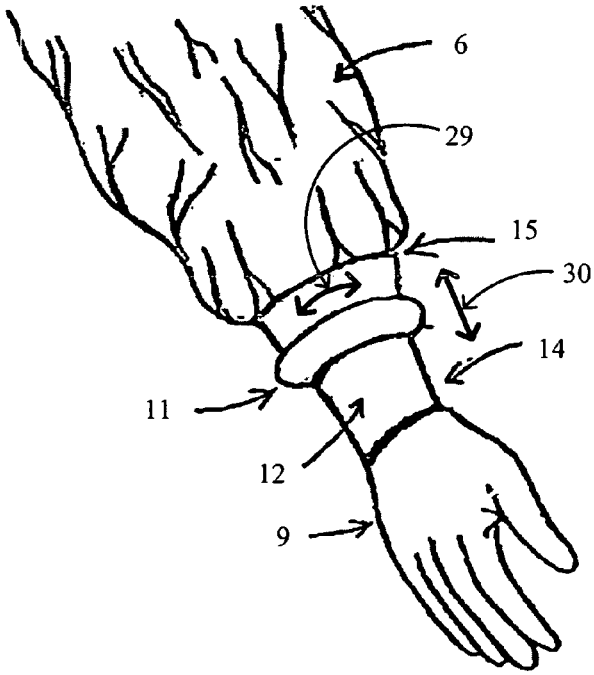
FIG. 10 shows the proximal end of the flap pulled over the glove cuff creating the fluid impervious seal.

FIG. 10 shows the proximal end (14) of the elastic folding flap (12) folded over the cuff (10), which is now hidden from view. The adhesion point (15) is now the most proximally located section of the elastic folding flap (12). Notice that the elastic folding flap (12) conforms smoothly over the cuff (10) and geometric bead (11) eliminating bunching and channel formation of material at the interface. In other words, the elastic folding flap (12) is elastically expansive in both a peripheral and longitudinal direction as shown by directional elasticity vectors (29) and (30) respectively. Because the elastic folding flap (12) is elastic, it constricts on the cuff (10) and geometric bead (11) to further increase the pressure of the fluid impervious seal. When using geometric beads 23 or 24 of FIG. 18, the seal and pressure is confined to a circumferential line or circle.

Figure 11:
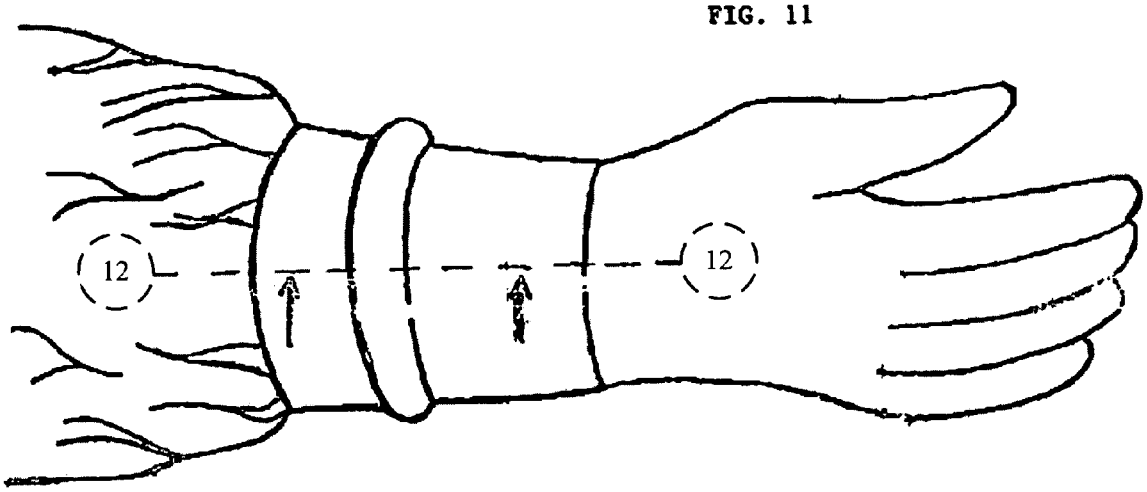
FIG. 11 is an enlarged view of FIG. 10.
Figure 12:
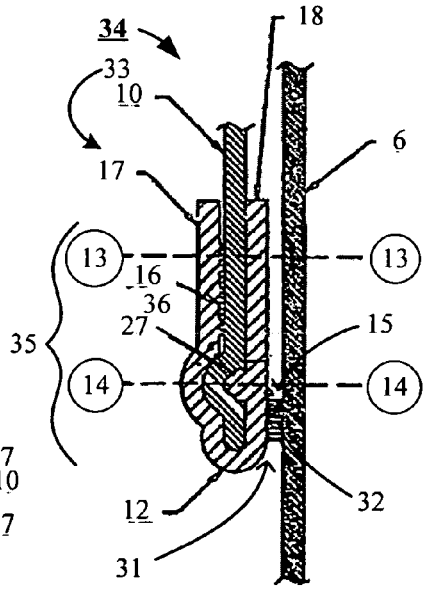
FIG. 12 is the cross section 12-12 of FIG. 11 viewed perpendicular to the longitudinal axis of the sleeve showing how the sleeve, flap, and glove interface.

FIG. 12 is the cross section view of FIG. 11. Only one side of the cross section is shown. It is to be understood that the opposite side would be the exact mirror image of FIG. 12. The arm of the user would reside to the right of the shown cross section in FIG. 12, and the assumed mirror image of FIG. 12 would be shown to the right of the arm of the user.

FIG. 12 shows the interface of the elastic folding flap (12) in conjunction with the cuff (10) and sleeve (6). Also shown is one of the preferred adhesion locations (15) between the elastic folding flap (12) and sleeve material (6). Adhesion may be accomplished by heat bonding, sewing, adhesives, or combination thereof that would not damage the integrity of either material and provide a liquid impervious seal. The cross sectional profile of the flap in FIG. 12 shows that the elastic folding flap forms a V-shape when folded and the cuff (10) resides in the middle of this V-shaped flap. Although the elastic folding flap is one part, it will now be described as an outer layer (17) and an inner layer (18) for clarity. FIG. 12 also shows a different style of geometrical bead (27) from the semicircular geometrical bead (11) shown in FIGS. 8 through 11. The geometrical bead (27) of FIG. 12 has a profile that comprises a semicircle resting on a rectangle, wherein the rectangle corners have a radius of curvature to remove any sharp angled edges. It should be noted that proper selection of the shape of the geometrical bead to match chosen materials is a crucial aspect of the seal. The shape is selected to allow the greatest fluid impervious seal, while preventing possible damage to the outer elastic layer (17) and cuff (10). Also shown in FIG. 12 is the addition of multiple rectangle beads, or ridges (16), that encircle the circumference of the inner surface of the outer layer (17) of the elastic folding flap (12). Preferably the selected elastic materials are durable enough to resist tearing so that bead profiles (23) or (24) may be used. However, the other profiles shown in FIGS. 12 and 18 have been shown to be satisfactory as well.

Additionally, FIG. 12 shows a pivot location (31) about which the elastic folding flap (12) may turn back over the limb extremity covering member cuff (10) of the limb extremity covering member (9) (of FIG. 10), and a sealing member (32) securing to the cuffed limb covering portion (6) to the elastic folding flap (12). Collectively, the cuffed limb covering portion (6) in conjunction with the sealing member (32), the elastic folding flap (12), and the limb extremity covering member cuff (10) of the limb extremity covering member (9) form a seal portion (33) of a garment (34), (also referred to herein as a surgical gown (34)).

Returning to FIG. 8, as shown therein, the cuffed limb covering portion (6) including the stockinet (7), together with the elastic folding flap (12) providing the geometric bead (11), in conjunction with the sealing member (32) (of FIG. 12) securing the elastic folding flap (12) to the limb covering portion (6), provide the retention region (35), (shown in greater detail by FIG. 12), proximal from the stockinet (7). It is noted that, with the elastic folding flap (12), including the geometric bead (11), secured to the cuffed limb covering portion (6), the retention region (35) presents a profile that precludes an unintentional movement of the limb extremity covering member (9) back over the retention region (35) once the limb extremity covering member (9) has been pulled over the retention region (35). The retention of the limb extremity covering member (9) adjacent the retention region is accomplished by a frictional force developed by an interaction between the limb extremity covering member (9) and the elastic folding flap (12), including the geometric bead (11) when the limb extremity covering member (9) is donned by the wearer and pulled at least partially over the retention region (35) (as seen in FIG. 9). Further friction is accomplished by at least a second bead or ridge (16) when the proximal end (14) of the flap is folded over the cuff (10) as shown in FIGS. 9-10 and 12.

Figure 13:
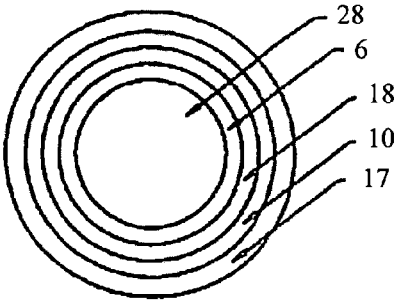
FIG. 13 is the cross section 13-13 of the donned assembly of FIG. 12 in the direction of the longitudinal axis of the arm.
Figure 14:
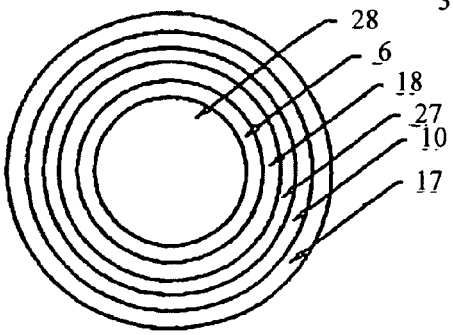
FIG. 14 is the cross section 14-14 of the donned assembly of FIG. 12 in the direction of the longitudinal axis of the arm including the geometrical bead on the outer surface of the distal end of the flap.

FIGS. 13 and 14 show cross sections looking down the longitudinal axis of the sleeve (6), as shown in FIG. 12. The adhesion point is not shown in these cross section views and the thickness of each layer is only for generalized graphical representation. It should be noted that varying thickness of any of the layers (6, 17, 27, 10, and 18) to increase stiffness or modify other properties of sections of the interface would not depart from the spirit of the invention. The central openings of FIGS. 13 and 14 represent the Wrist of the user (28). FIG. 14 is the cross section located at the geometrical bead (27) on the elastic folding flap (12) of FIG. 12. Therefore the added thickness of FIG. 14 versus FIG. 13 is the geometric bead (27) on the inner layer (18) of the elastic folding flap. It is noted that, the geometric bead (27) is shown by FIG. 14 to be continuous and circumferentially extending around the sleeve (6).

Figure 15:
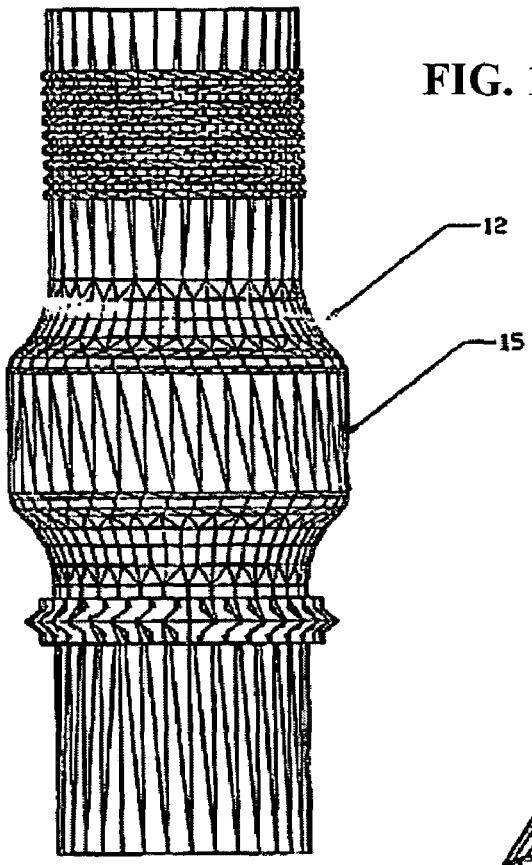
FIG. 15 is a profile view of the flap of FIGS. 8-14 utilizing one adhesion point in the center, a geometric bead consisting of a combination of a triangle and rectangle, and ridges to increase friction.
Figure 16:
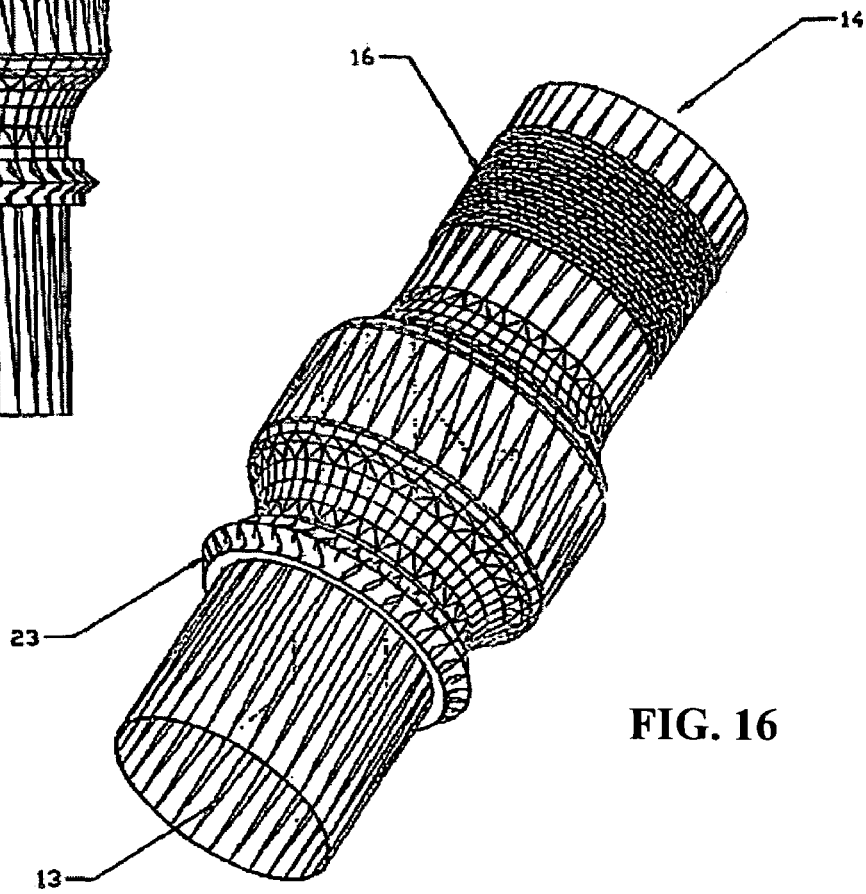
FIG. 16 is an angle view of the elastic flap shown in FIG. 15.

FIG. 15 shows the profile of the embodiment of the invention shown in FIGS. 8-12 before the elastic folding flap (12) is attached to the sleeve. The attachment point (15) is located near the center where the circumference is the greatest. This circumference may vary depending on the circumference of the sleeve, and which the flap is to be used with the sleeve. This circumference should range between from 10 cm to 60 cm. FIG. 16 shows FIG. 15 at an angle so that it is clear that the elastic flap is a thin hollow shell or tube. The circumference of the distal end (bottom of FIG. 15) and proximal end (top of FIG. 15) is selected similarly as described with the first embodiment. The ridges (16) are shown most clearly in FIGS. 15 and 16. The profile of each ridge (16) could be composed of numerous shapes as shown in FIG. 18 to increase friction between the layers resulting in reduced opportunity for the assembly to separate during use. When the proximal end of the elastic folding flap (14) is folded over the glove cuff and distal end of the elastic folding flap (13), the ridges serve to grip on the glove cuff to prevent the sleeve from sliding out of the glove. This is more clearly shown in FIG. 12. The geometric bead (23) of FIGS. 15 and 16 is shown in greater detail in FIG. 17 and in the profile view (23) of FIG. 18.

Figure 17:
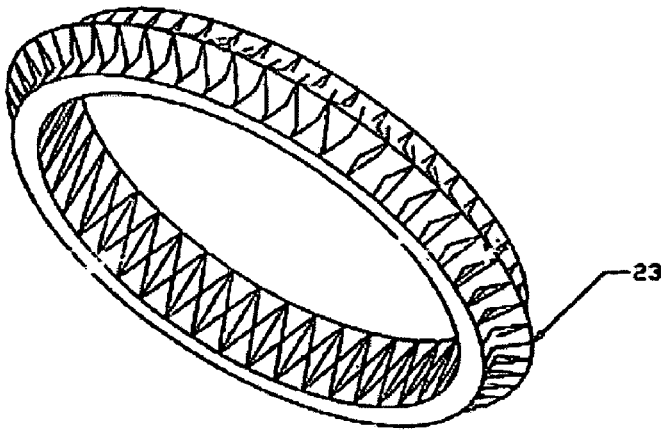
FIG. 17 is another embodiment of the invention wherein a geometric bead may be placed over the flap or used alone with only a sleeve and glove.
Figure 22:
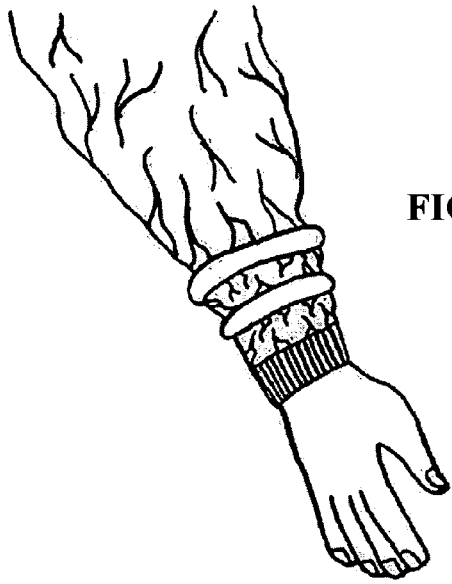
FIG. 22 shows a third embodiment of the present invention having beads attached directly to the sleeve.
Figure 23:
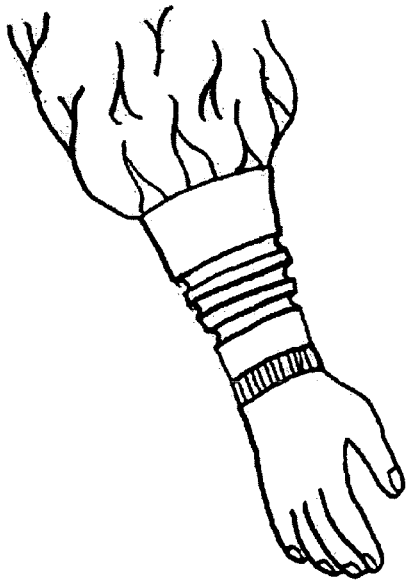
FIG. 23 shows an alternate embodiment of the flap.
Figure 24:
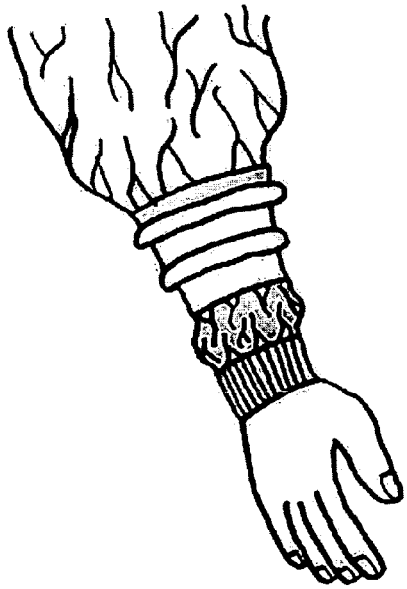
FIG. 24 shows an alternate embodiment of the flap.
Figure 25:
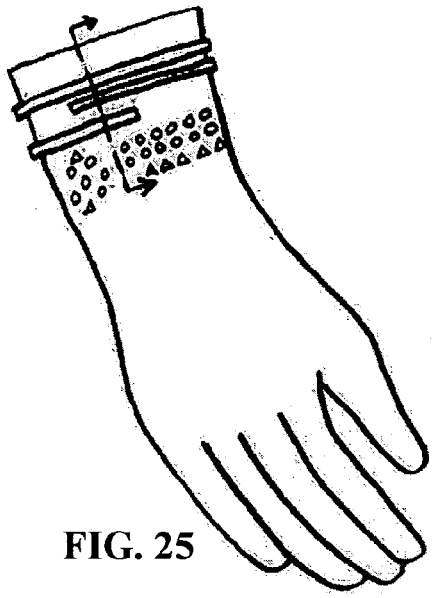
FIGS. 25-30 show several embodiments of a glove used with the present invention.
Figure 26:
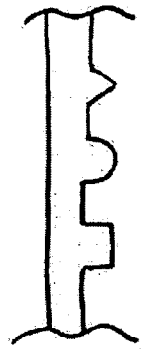
Figure 27:
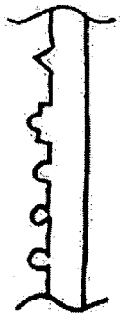
Figure 28:
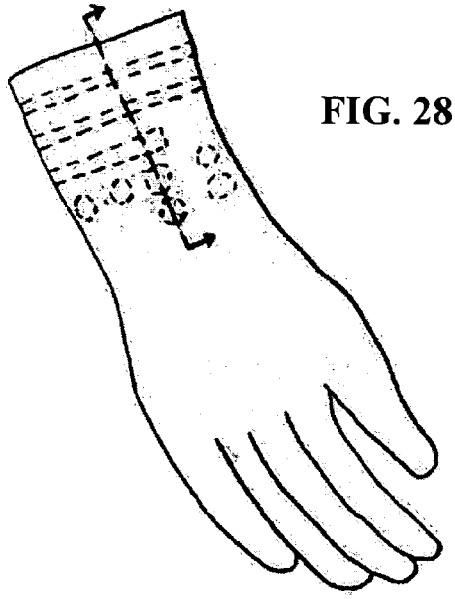
Figure 29:
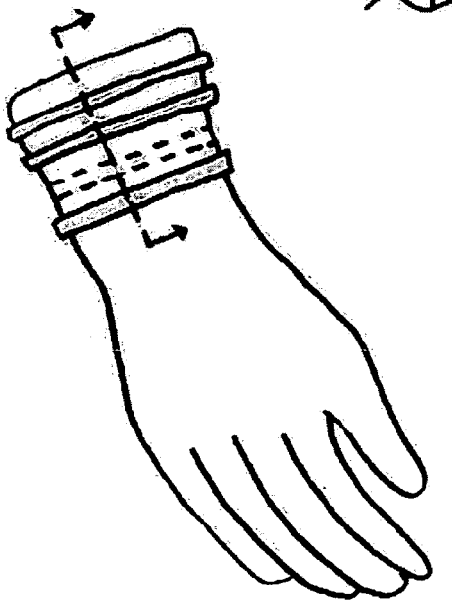
Figure 30:
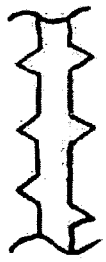

FIGS. 17 and 22 shows that the geometric bead (23) could serve as a separate component to the elastic folding flap (12) or elastic pullover flap (2) rather than being formed integral with the folding flap or pullover flap. In addition, it is contemplated that the geometric bead of FIG. 17 may be used alone with a sleeve and glove to create an impervious seal. In this embodiment the geometric bead may be considered a band that can be attached or detached from the sleeve depending on the characteristics of the sleeve. However, as with all embodiments of the invention, a uniformly continuous seal must be present between the bead and sleeve, bead and glove, flap and sleeve, or flap and glove to prevent fluids and particles from passing through the interface.

FIG. 18 shows cross sectional profiles of the possible geometric bead shapes for all embodiments described above. The shapes comprise a rectangle (20), square (21), circle (22), rectangle-triangle combination (23), triangle (24), circle-rectangle combination (25), and a semicircle (26). The preferred profile is the triangle-rectangle combination (23) shown in FIGS. 15 through 17. The bead or ridges may be continuous or non-continuous, interrupted, or non-interrupted. Multiple beads and ridges may be present forming a surface texture pattern. Depending on durability of the flap and glove materials it may be desirable to reduce sharp angled edges by providing curvature to each edge.

Figure 19:
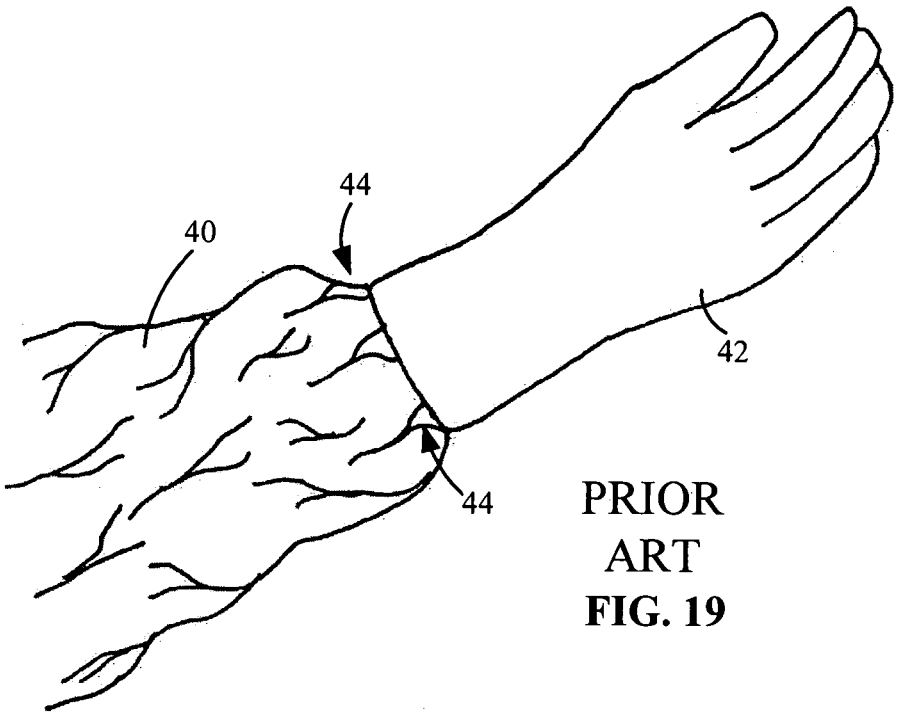
PRIOR ART FIG. 19
FIG. 19 is a prior art baggy sleeve used with a glove, which creates channels.

FIG. 19 shows a gown sleeve 40, a glove 42, and channels 44 created by the interaction of the glove 42 with the gown sleeve 40 in the prior art. The glove 42 compresses the gown sleeve 40 against a wearer's forearm forming the channels 44.

In the above embodiments, beads, ridges, protrusions, indentations, and other surface textures may be present on the flap which connects the gown to the glove, as seen in FIGS. 1-3, 8-12, 15, 16, and 20. The surface textures may be present on the inner surface of the flap, the outer surface of the flap, or both surfaces of the flap.

In another embodiment of the invention, beads, ridges, protrusions, indentations, and other surface textures may be present onto the inner surface, outer surface, or both surfaces of the glove cuff, as seen in FIGS. 25-30.

Figure 20:
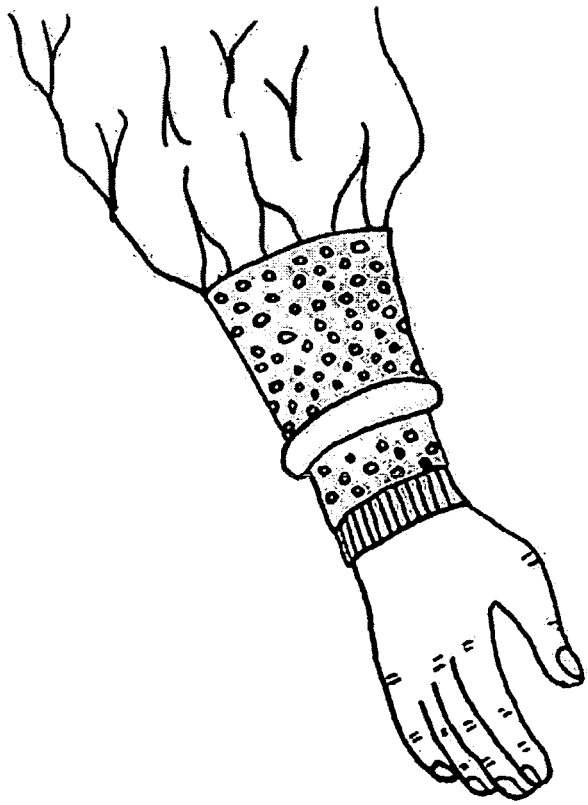
FIG. 20 shows an alternate embodiment of the flap.
Figure 21:
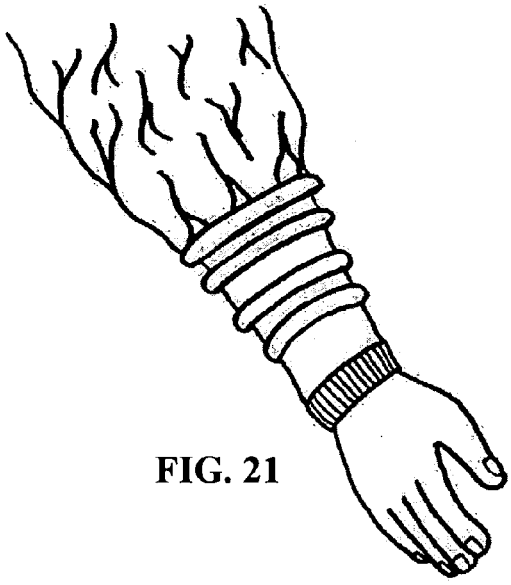
FIG. 21 shows an alternate embodiment of the flap.

In another embodiment of the invention, beads, ridges, and other surface textures may be present directly onto the surface of the gown sleeve, as seen in FIGS. 20 and 22.

Any of the above embodiments may be combined in order to provide interlocking surface texture patterns. For example, surface textures on a glove may interlock with surface textures on a gown sleeve. Surface textures on a glove may also interlock with surface textures on the flap, which connects the gown and glove. Surface textures on one end of the flap may interlock with surface textures on an opposite end of the flap. The interlocking surface textures provide increased friction, preventing the glove from being accidentally pulled off of the gown sleeve, increased distance any fluids would need to travel to get through the interface, and blockage of any air pockets or channels at the interface, preventing fluid from going through.

The preferred method of removal will now be described. During the surgical procedure, the components of the attachment assembly are interlocked together. Because they are locked together, they must be removed as one piece. The gown is simply removed by everting the body of the gown and shoulder portion of the sleeves, over the forearm portion of the sleeves, turning the gown inside out, removing the entire attachment assembly with attached glove from the inside out. Because the gown, glove, and attachment assembly is removed inside out as one piece, the fluid impervious seal is never broken, decreasing the chance of fluid contamination, and also shortening the time of removal.

The components of the invention described above may be made by processes known in the art such as extruding, molding dipping, spraying, deposition processes, or combinations thereof. A preferred method of coating a texture pattern onto a glove, gown, or flap, is by dipping, spraying, or deposition. A preferred method of forming a flap will now be described. A substantially cylindrical mold slightly larger than the size of wrist, having the reverse of a desired surface texture is supplied. The mold is dip coated with the desired elastic material to form the flap having a surface texture opposite of the mold. Once the material has dried, the flap is removed from the mold. This may be accomplished by everting the flap upon itself and pulling it off the mold, or dissolving the mold itself. A surgical gown is supplied and the sleeves of the gown are expanded so that they are pulled taut having no channels or bunching in the fabric. This may be accomplished by providing an expander inside the gown sleeve, such as a balloon. An adhesive is circumferentially applied to the gown sleeve at the location of desired attachment of the flap. The flap is then itself expanded and moved coaxially over the expanded gown sleeve and aligned so that the adhesive is located between the gown sleeve and the flap. The adhesive may be located on the gown such that it is attached to the flap at the proximal end of the flap, the distal end of the flap, or anywhere in-between. The gown may then be released back to its original unstressed configuration, such as by deflating of the balloon, or removal of an expander. In doing so, the flap will contract back down to a diameter substantially the size of ones wrist, and eliminate any bunching and channels on the outer surface of the gown sleeve that previously were present at the interface. The gown sleeve with attached flap is then ready for use.

The components of the invention described above may comprise any known biocompatible materials exhibiting elastic and impermeable properties such as polytetrafluoroethylene (PTFE), silicone, polyurethane, polyvinyl alcohol (PVA), natural and synthetic elastomers such as latex, other polymers, or a combination thereof. The fluid impermeability characteristics of the flap and bead should be equal to or greater than the glove and gown. Furthermore, the materials may comprise coatings or impregnation of drugs to kill bacteria or microorganisms on contact.

While preferred embodiments have been shown, it will be understood that the invention is capable of numerous modifications, rearrangements, and substitution of parts without departing from the uniqueness of this invention as set forth in the claims section of this application. Although described in detail for hazardous environment applications such as surgery, this invention may be used with other garments to be used for various applications such as skiing, rain gear, motorcycle apparel, general laboratory garments, underwater diving garments, or any other garments desiring protection of the body from fluids.

What is claimed is:

1. A gown for use during surgery comprising;

a body portion, at least one sleeve, an elastic, stretchable material disposed on the at least one sleeve surface, wherein the elastic stretchable material comprises a plurality of surface irregularities, each surface irregularity being spaced apart from one another and located on the surface of said material, wherein each surface irregularity provides a varying thickness of said elastic, stretchable material, and at least one cuff located distal to the at least one sleeve.

2. The gown of claim 1, wherein said surface irregularity is designed to interlock with another component.

3. The gown of claim 1, wherein the surface irregularity comprises a textured profile.

4. The gown of claim 1, wherein the surface irregularity is selected from the group consisting of beads, ridges, protrusions, indentations, and combinations thereof.

5. The gown of claim 1, wherein the elastic stretchable material comprises a coating on the sleeve.

6. The gown of claim 1, wherein the elastic stretchable material encircles the sleeve.

7. The gown of claim 6, wherein the elastic stretchable material comprises a circumferential ring.

8. The gown of claim 1, wherein the surface irregularities are interlockable in a manner selected from the group consisting of distal and proximal surface irregularities interlock with one another, distal surface irregularity interlocks with a separate second component, proximal surface irregularity interlocks with a separate second component, both distal and proximal surface irregularities interlock with a separate second component, and distal and proximal surface irregularities interlock with one another as well as a separate second component.

9. The gown of claim 8, wherein the separate second component is a glove.

10. The gown of claim 9, wherein the glove has at least one surface irregularity that interlocks with surface irregularities on the sleeve surface.

11. A gown for use during surgery comprising;

a body portion, at least one sleeve, an elastic, stretchable material disposed on the at least one sleeve surface, wherein the elastic stretchable material encircles the at least one sleeve and comprises a tubular band having a distal end and a proximal end, the band comprising at least two surface irregularities, said surface irregularities spaced apart from one another, and at least one cuff located distal to the at least one sleeve.

12. The gown of claim 11, wherein the surface irregularities are interlockable in a manner selected from the group consisting of distal and proximal surface irregularities interlock with one another, distal surface irregularity interlocks with a separate second component, proximal surface irregularity interlocks with a separate second component, both distal and proximal surface irregularities interlock with a separate second component, and distal and proximal surface irregularities interlock with one another as well as a separate second component.

13. The gown of claim 12, wherein the separate second component is a glove.

14. The gown of claim 13, wherein the glove has at least one surface irregularity that interlocks with surface irregularities on the sleeve surface.

15. A gown for use during surgery comprising;

a body portion, at least one sleeve, an elastic, stretchable material disposed on and encircling the at least one sleeve surface, wherein the elastic stretchable material is solid and has a surface comprising at least one surface irregularity, and at least one sleeve cuff located distal to the at least one sleeve.

16. The gown of claim 15, wherein the entirety of the elastic, stretchable material is spaced proximally from said at least one sleeve cuff.

17. The gown of claim 15, wherein the solid elastic, stretchable material has a thickness, and the at least one surface irregularity forms a variation of the thickness of the elastic, stretchable material.

18. The gown of claim 15, wherein the elastic, stretchable material is attached to the at least one sleeve by one or two sealing members, each sealing member spaced proximally from said at least one sleeve cuff.

19. The gown of claim 15, wherein the surface irregularity comprises at least one circumferentially continuous angled edge so that at least one circumferentially continuous fluid impervious seal may be formed with a glove cuff when said glove cuff is donned over the at least one angled edge.

20. The gown of claim 19, wherein the at least one angled edge comprises two or three angled edges.

* * * * *